US007633444B2

(12) United States Patent
Takei et al.

(10) Patent No.: US 7,633,444 B2
(45) **Date of Patent: *Dec. 15, 2009**

(54) DISTRIBUTED PHASE TYPE CIRCULAR POLARIZED RECEIVING MODULE AND PORTABLE RADIO COMMUNICATION DEVICE

(75) Inventors: Ken Takei, Kawasaki (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 19 days.

This patent is subject to a terminal disclaimer.

(21) Appl. No.: 11/431,096

(22) Filed: May 10, 2006

(65) Prior Publication Data

US 2006/0256022 A1 Nov. 16, 2006

(30) Foreign Application Priority Data

May 11, 2005 (JP) ..... 2005-138645

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS, 846

See application file for complete search history.

(56) References Cited

U.S. PATENT DOCUMENTS

| | | | | |
|---|---|---|---|---|
| 5,264,861 | A | 11/1993 | Roederer et al. | |
| 6,040,806 | A * | 3/2000 | Kushihi et al. | 343/853 |
| 7,034,770 | B2 * | 4/2006 | Yang et al. | 343/793 |
| 2004/0001021 | A1 * | 1/2004 | Choo et al. | 343/700 MS |
| 2004/0085138 | A1 * | 5/2004 | Franca-Neto | 330/311 |
| 2005/0168383 | A1 * | 8/2005 | Lee | 343/700 MS |
| 2005/0259007 | A1 * | 11/2005 | Horie et al. | 343/700 MS |

FOREIGN PATENT DOCUMENTS

| | | |
|---|---|---|
| JP | 1-158805 | 6/1989 |
| JP | 5-152842 | 6/1993 |
| JP | 5-275918 | 10/1993 |
| JP | 11-205028 | 7/1999 |
| JP | 2000-341035 | 12/2000 |
| JP | 2001-007632 | 1/2001 |
| JP | 2002-076765 | 3/2002 |
| JP | 2002-164732 | 6/2002 |
| JP | 2003-049227 | 2/2003 |
| JP | 2003-101320 | 4/2003 |
| JP | 2003-204211 | 7/2003 |
| JP | 2005-530439 | 10/2005 |
| WO | WO 2004/001900 | 12/2003 |

OTHER PUBLICATIONS

Japanese Office Action dated Nov. 11, 2008 with English-Language Translation.

* cited by examiner

*Primary Examiner*—Hoang V Nguyen
*Assistant Examiner*—Robert Karacsony
(74) *Attorney, Agent, or Firm*—McGinn IP Law Group, PLLC

(57) ABSTRACT

A distributed phase type circular polarized receiving module provided with a plane, a power feed point 4 formed on the plane, and a group of narrow conductors 101 having a substantially one-dimensional current distribution, and the narrow conductors being distributed in two dimension on the plane, a transistor 9 connected to the power feed point 4, sums of projections of complex vectors of current distributions induced on the narrow conductors 101 in first and second directions orthogonal to each other defined on the plane are determined in amplitude and phase, such that amplitudes are approximately equal to each other and a phase difference is approximately 90°.

3 Claims, 8 Drawing Sheets

DISTRIBUTED PHASE TYPE CIRCULAR POLARIZED RECEIVING MODULE AND PORTABLE RADIO COMMUNICATION DEVICE

The present application is based on Japanese Patent Application No. 2005-138645 filed on May 11, 2005, the entire contents of which are incorporated herein by reference.

BACKGROUND OF THE INVENTION

1. Field of the Invention

The present invention relates to a high-frequency module and a radio communication device that are applied to a radio communication-related equipment for providing a user with a radio communication system service, such as satellite broadcasting, global positioning system (GPS) using a circular polarized wave, in more particularly, to a small-sized thin type distributed phase type circular polarized wave receiving module and a radio communication device mounting the same, which is suitable for providing the user with radio communication system by the medium of electromagnetic wave having a wavelength greater than dimensions of the radio communication device.

2. Description of the Related Art

Among various radio communication system, many satellite-using systems such as seamless international telephone, satellite broadcasting, GPS, are operated, by making full use of advantages thereof, e.g. a seamless services over different countries can be provided, and a shielding effect of tall structures is small, since an electromagnetic wave used as a communication medium is transmitted from a substantially vertical (zenith) direction.

On one hand, the seamless services can be provided internationally. On the other hand, a possibility that the electromagnetic wave is leaked to other countries and other regions is inevitably high so that different polarized waves (right-handed circular polarized wave and left-handed circular polarized wave) are assigned to neighboring countries and neighboring regions by using circular polarized wave, so as to solve the problem of electromagnetic wave leakage. The right-handed circular polarized wave cannot be received by a left-handed circular polarized wave antenna, and the left-handed circular polarized wave cannot be received by a right-handed circular polarized wave antenna. Only a half power of the circular polarized wave can be received by a linear polarized wave antenna. Therefore, so as to provide effectively the user with a radio communication services using the electromagnetic wave of a circular polarized wave, means for realizing the circular polarized wave antenna becomes an important technical problem.

As the means for realizing circular polarized wave antenna, two methods are conventionally known and are put to practical use.

A first conventional method is to dispose two linear polarized wave antennas orthogonally to each other, and feeding phases of the respective antennas are shifted by 90°. A cross dipole is well known as a representative example of the first conventional method, as shown in "Illustrated antenna (zusetsu antenna)" by Naohisa Goto, 1995, Institute of Electronics, Information and Communication Engineers, page 219. However, in the first conventional method, two power feed parts are required, and means for shifting the respective power feed parts by 90° (e.g. phase converter) are further required. In the first conventional method, there is a disadvantage in that a circuit size of a radio communication device using the antenna is enlarged, so that there is problem in miniaturization of the radio communication device.

A second conventional method is to use a periphery-opened patch antenna such as a microstrip antenna, namely, to realize a circular polarized wave antenna with a single power feed point by using a rectangular or circular two-dimensional patch, which extends along two axes orthogonal to each other. For example, as shown in "Small size plane antenna" by Misao Haneishi et al, 1996, Institute of Electronics, Information and Communication Engineers, pages 143 to 145, a regular square or circle is such deformed that one side is shorter and another side is longer along the two axes orthogonal to each other. As a result, a length of one side of the regular square or a half circumference length of one side of the circle is made different from another side, and the length of each side is slightly shorter or longer than ½ wavelength of the receiving wavelength. Viewed from a power feed point, the length of the side along the respective axes orthogonal to each other functions as inductance or capacitance, and a feeding phase to the length of the side of the respective axes is shifted by 90°. The second conventional method is more advantageous than the first conventional method, since only the single power feed point is provided and a circuit size of a high-frequency circuit for supplying a high-frequency power to the antenna can be significantly reduced. Therefore, the second conventional method is actually most commercialized.

However, when using the second conventional method, two-dimensional size of substantially ½ wavelength of the radio wave received by the antenna should be assured as outer dimensions of the antenna, namely, an area of a regular square having one side of substantially ½ wavelength should be assured. Accordingly, there is an obstacle for application to a palm sized small terminal that is currently desired.

In the satellite communication system, there is another problem in that it is difficult to obtain a reception sensitivity required in the radio communication, since a distance from the satellite to the radio communication terminal is significantly greater than a communication system using the ground wave (terrestrial communication) so that the electromagnetic wave energy arriving at the radio communication terminal becomes small. For solving this problem, it is indispensable to amplify the electromagnetic wave energy for reproducing a signal superposed on the electromagnetic wave. In this amplification, it is important to avoid the interfusion of unnecessary noise, such as external noise, thermal noise as much as possible. Since the gain of the antenna increases in proportion to a physical length, the miniaturization of the antenna will deteriorate the gain of the antenna. Accordingly, the present technical problem is to develop a novel means for realizing a small sized circular polarized wave receiving module, which provides a signal-to-noise ratio (S/N ratio) low enough to communicate with a small sized and user-friendly mobile terminal which is applicable to the satellite radio communication system.

SUMMARY OF THE INVENTION

Accordingly, it is an object of the present invention to provide a distributed phase type circular polarized wave receiving module with a small size and low S/N ratio, which provides the user with a radio communication service using an electromagnetic wave of circular polarized wave, represented by a satellite radio communication system.

It is another object of the invention to provide also a radio communication device mounting the circular polarized wave receiving module.

According to a first feature of the invention, a distributed phase type circular polarized receiving module, comprises:

a first plane;

a power feed point formed on the first plane;

a first group of narrow conductors having a substantially one-dimensional current distribution, the first group of narrow conductors being distributed in two dimension on the first plane; and a transistor connected to the power feed point;

wherein:

sums of projections of complex vectors of current distributions induced on the narrow conductors in first and second directions orthogonal to each other defined on the first plane are determined in amplitude and phase, such that amplitudes are approximately equal to each other and a phase difference is approximately 90°.

The distributed phase type circular polarized receiving module may further comprises:

a second plane; and a second group of narrow conductors having a substantially one-dimensional current distribution, the second group of narrow conductors being distributed in two dimension on the second plane;

wherein:

sums of projections of complex vectors of current distributions induced on the narrow conductors in first and second directions orthogonal to each other defined on the first and second planes are determined in amplitude and phase, such that amplitudes are approximately equal to each other and a phase difference is approximately 90°.

In the distributed phase type circular polarized receiving module, a space between the first plane and the second plane may be filled with a dielectric material.

In the distributed phase type circular polarized receiving module, the first group of narrow conductors and the second group of narrow conductors may be coupled to each other and the power feed point is included in the narrow conductors.

In the distributed phase type circular polarized receiving module, a first finite reactance component of the narrow conductors and a second finite reactance component of the transistor may be generated with respect to the power feed point, and the first finite reactance component and the second finite reactance component have same values with opposite signs.

In the distributed phase type circular polarized receiving module, the transistor may comprise a bias circuit for power supply.

The distributed phase type circular polarized receiving module may further comprises:

a power feed terminal; and a signal output terminal.

The distributed phase type circular polarized receiving module may further comprise a conductor plate having a finite grounding potential.

The distributed phase type circular polarized receiving module may further comprise:

a AC/DC separating capacitor; and a coaxial cable;

wherein one end of the AC/DC separating capacitor is coupled to the signal output terminal, another end of the AC/DC separating capacitor and the power feed terminal are simultaneously coupled to one end of the coaxial cable, and another end of the coaxial cable functions as an external signal transmitting terminal and an external terminal for power supply.

According to a second feature of the invention, a portable radio communication device comprises:

a distributed phase type circular polarized receiving module which comprises:

a plane;

a power feed point formed on the plane;

a group of narrow conductors having a substantially one-dimensional current distribution, the narrow conductors being distributed in two dimension on the plane; and a transistor connected to the power feed point;

wherein:

sums of projections of complex vectors of current distributions induced on the narrow conductors in first and second directions orthogonal to each other defined on the plane are determined in amplitude and phase, such that amplitudes are approximately equal to each other and a phase difference is approximately 90°

According to the present invention, since the electromagnetic wave energy captured by a circular polarized wave antenna can be amplified with low loss and low noise by using a transistor circuit, it is possible to realize a small sized circular polarized wave receiving module with high gain and high efficiency.

Further, it is possible to provide radio communication services using the circular polarized wave without largely increasing the dimensions of the device, by mounting the small sized circular polarized wave receiving module on a portable radio communication device. Therefore, it is possible to improve the quality of service for the user of the radio communication terminal while keeping the convenience in storage, portability, etc.

BRIEF DESCRIPTION OF THE DRAWINGS

Preferred embodiments present invention will be described in conjunction with appended drawings, wherein:

FIGS. 5A to 5C are schematic diagrams showing a distributed phase type circular polarized wave receiving module in a second preferred embodiment according to the invention, wherein FIG. 5A is a perspective view showing a structure of the distributed phase type circular polarized wave receiving module, FIG. 5B is a side view of the distributed phase type circular polarized wave receiving module viewed from a point A, FIG. 5C is a side view of the distributed phase type circular polarized wave receiving module viewed from a point B;

DETAILED DESCRIPTION OF THE PREFERRED EMBODIMENTS

Figure 1:
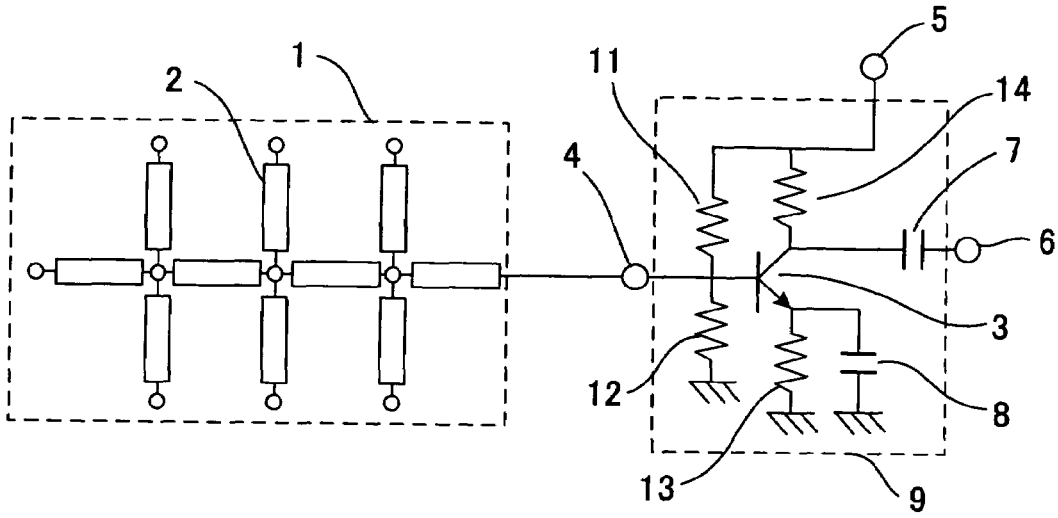
FIG. 1 is a circuitry diagram showing a distributed phase type circular polarized wave receiving module in a first preferred embodiment according to the invention.

A distributed phase type circular polarized wave receiving module according to the present invention is a distributed phase type circular polarized wave receiving module comprising a distributed phase type antenna having a collective structure of narrow conductor lines is directly coupled to an amplifier circuit using a transistor, in which an impedance of the transistor satisfies a good noise characteristics and an impedance of a power feed point, which conjugates with the transistor impedance, satisfies a good circular polarized wave condition.

The technical problem of the present invention is to provide a small sized and high gain circular polarized wave receiving module. As means for solving the problems, a distributed phase type antenna is used as a circular polarized wave receiving antenna, a group of rectangular conductors of the distributed phase type antenna is selected to match with the impedance of the transistor for the amplifier with the low noise characteristics and the impedance having a finite reactance which conjugates with the transistor impedance.

By utilizing a concept of leakage loss transmission line disclosed by JP-A-1-158805, the Inventors are studying on a novel technology for providing an antenna for receiving a circular polarized wave, in which a group of narrow conductor lines composing the antenna are formed on a same plane (a virtual plane) and one point in the group of narrow conductor lines is provided as a power feed point. Each of the narrow conductor lines is divided to be small enough (1/50 or less). Then, a sum of projections of complex vectors of induced current at each divided point to two axes orthogonal to each other that are arbitrarily provided on a same plane is calculated for each axis. If amplitudes of the sums of respective axes are equal to each other and a phase difference in the sums of the respective axes is 90°, the group of the narrow conductor lines composes a circular polarized wave antenna.

Accordingly, design of the circular polarized wave antenna is nothing else to determine the impedance of the antenna viewed from the power feed point at a constant value while satisfying the aforementioned circular polarized wave conditions. For this case, the antenna structure having an axis ratio satisfying the optimal circular polarized wave conditions may not satisfy the predetermined impedance conditions sufficiently.

Generally, the design of a high-frequency circuit is realized assuming that an input and output impedances of individual parts are kept to be 50Ω. However, it is very few that the impedance of the power feed point in the antenna is 50Ω, particularly in a small sized circular polarized wave antenna in which an electric length of the dimensions is less than ¼ wavelength. On the other hand, it has been known that a semiconductor transistor, which is a solid element amplifying the electromagnetic wave energy received by the antenna, inherently has a noise generating factor such as shot noise which is different from the thermal noise, and that a noise figure (NF) is varied in accordance with a load impedance coupled to the transistor. The NF indicates a level of the noise interfused when the signal is amplified. In the conventional semiconductor transistor, the load impedance providing the minimum NF is hardly 50Ω.

When the convention method for designing the high-frequency circuit is applied to the design of the small sized circular polarized wave receiving module, it is indispensable to provide a matching circuit for converting a first optimal impedance keeping a good circular polarized wave condition and a second optimal impedance keeping a good noise figure between the transistor and the antenna. However, if this matching circuit is realized by a real element, thermal noise due to a resistance component included in the element itself will be inevitably interfused. As a result, the noise figure as the whole circular polarized wave receiving module will be deteriorated.

Further, in the field of the microwave used in the existing satellite communications, such as global positioning system, introduction of the transmission line having an electric length of around ¼ wavelength is usually necessary for realizing the matching circuit. Since the electric length of the transmission line is determined by several centimeter orders, the dimension of the matching circuit itself is increased, which is extremely disadvantageous when the circular polarized wave receiving module is expected to be mounted in the portable and small sized radio communication device.

The above problem may be overcome by modifying the design method proposed by the Inventors. In concrete, this technical problem may be solved by searching the group of narrow conductor lines, in which an impedance for providing the transistor with a good noise figure and an impedance for providing the antenna with a good circular polarized wave radiation are conjugated with each other.

When the antenna is remarkably miniaturized in comparison with the wavelength to be used, the electromagnetic wave that can be emitted from the antenna decreases. As a result, a Q-value of the antenna increases. The antenna with a high Q-value is provided with a resonance characteristic that inherently comprises a damping factor in the impedance characteristics. Therefore, in such antenna with high Q-value, the reactance component having finite positive and negative values can be easily realized.

In the existing semiconductor transistor, the load impedance for optimizing the noise figure generally comprises the finite reactance component. Therefore, in design of the circular polarized wave receiving module according to the invention, it is possible to realize a complex conjugate relationship between the transistor impedance with a good noise figure and the antenna impedance with a good circular polarized wave radiation in the antenna with dimensions of ⅛ wavelength to ¼ wavelength.

As to choice of the transistor, it is sufficient if the input impedance showing the low noise characteristics comprises a finite reactance value. Therefore, a field-effect transistor may be selected. Depending on a frequency band for which the distributed phase type circular polarized wave module is used, a transistor made of an appropriate semiconductor material such as silicon, silicon-germanium compound system may be selected. For example, in the global positioning system using frequency of 1.5 GHz, a HEMT (High Electron Mobility Transistor), one of the field effect transistors, can be used. Since the input impedance showing low noise characteristics in a frequency band of the HEMT has a finite positive reactance value, the group of the rectangular conductors with a good axis ratio may be searched for providing the distributed phase type antenna under the condition that the impedance of the power feed point has a finite negative reactance value. This searching condition is actually possible, and the search is finished in success to realize the group of narrow conductors having the dimension slightly more than ⅛ wavelength of the applicable electromagnetic wave.

Next, preferred embodiments according to the present invention will be explained in more detail in conjunction with appended drawings.

A distributed phase type circular polarized wave receiving module in a first preferred embodiment according to the invention will be explained referring to FIG. 1.

FIG. 1 is a circuitry diagram showing a distributed phase type circular polarized wave receiving module in a first preferred embodiment according to the invention;

As for a physical configuration of a circular polarized wave antenna 1 shown in FIG. 1, the circular polarized wave antenna 1 comprises a group of a plurality of narrow conductors. The equivalent circuit showing the electrical characteristics of this circular polarized wave antenna 1 is expressed as connection of the transmission lines 2.

In the distributed phase type circular polarized wave receiving module according to the present invention, the circular polarized wave antenna 1 is coupled to a transistor circuit 9 at a power feed point 4 that is one terminal of the transmission lines 2.

The transistor circuit 9 includes a bipolar transistor 3 as an essential component. Bias resistances 11, 12 are coupled to a base of the bipolar transistor 3, and a direct current (DC) potential of the base is determined by the bias resistances 11, 12. The bias resistance 11 is connected to a power feed terminal 5 and the other bias resistance 12 is connected to a grounding potential. An emitter of the bipolar transistor 3 is connected to the grounding potentials and a DC feedback resistance 13 and a bypass capacitor 8 are interposed in parallel between the emitter of the bipolar transistor 3 and the grounding potentials. A collector of the bipolar transistor 3 is connected to the power feed terminal 5 and a signal output terminal 6, and a load resistance 14 is interposed between the collector of the bipolar transistor 3 and the power feed terminal 5, and a DC cut capacitor 7 is interposed between the collector of the bipolar transistor 3 and the signal output terminal 6.

The impedance characteristics of the circular polarized wave antenna 1 can be expressed by the coupling topology of transmission lines 2, and each length of the topology and the transmission lines 2 is determined such that the circular polarized wave antenna 1 satisfies the good circular polarized wave conditions.

The transistor circuit 9 is a general type amplifier circuit, and a high-frequency signal received by the circular polarized wave antenna 1 is input to the transistor circuit 9 from the power feed point 4, and an amplitude of the high-frequency signal is amplified and output from the signal output terminal 6. Since a DC power should be fed from the outside to the transistor circuit 9 to operate the transistor circuit 9 as an amplifier, the DC power is supplied from the power feed terminal 5. Generally, in the high-frequency region of the microwave band, a region of the input impedance of the transistor 3 in which the transistor 3 can keep the good noise figure is limited.

Figure 2:
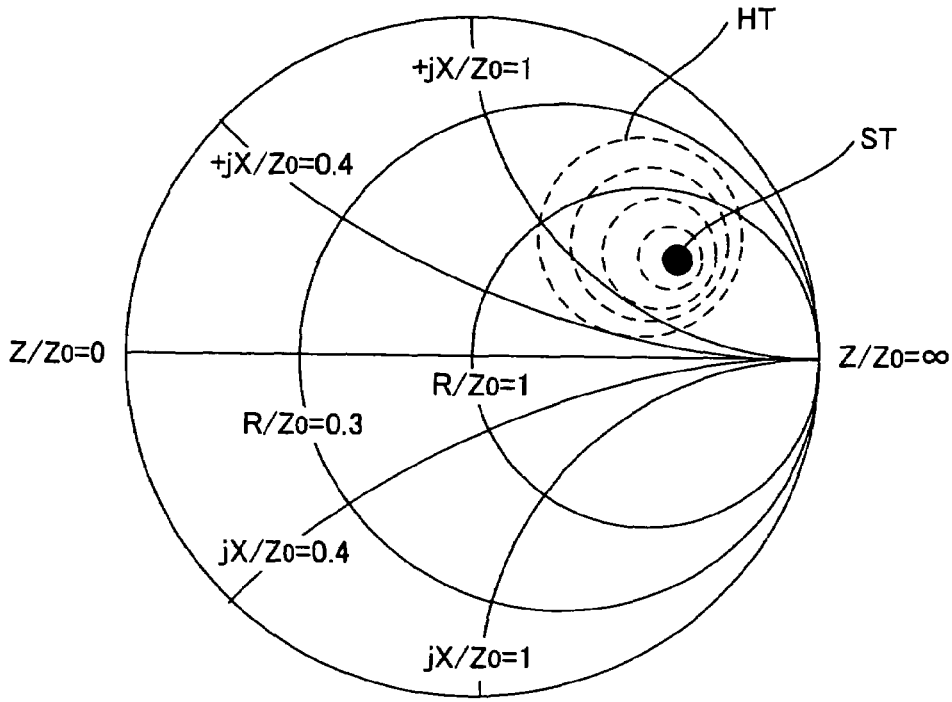
FIG. 2 is a Smith chart showing noise characteristics of a transistor constituting the distributed phase type circular polarized wave receiving module in the first preferred embodiment according to the invention.

FIG. 2 is a Smith chart showing noise characteristics of a transistor constituting the distributed phase type circular polarized wave receiving module in the first preferred embodiment according to the invention.

For example, the input impedance can be expressed in a contour plot HT (broken line) of the Smith chart shown in FIG. 2, and a non-concentric circular distribution is presented around an optimal point ST as a center of the distribution.

In other words, the input impedance of the transistor and the NF (noise figure) in the input impedance of transistor are measured. Since all impedances which can be realized are projected in an outermost contour circle in the Smith chart, when the impedance showing a specific NF is plotted, an ellipse is presented as the contour plot HT in the Smith chart. In accordance with decrease of the NF value, a circumferential length of the ellipse becomes short, and gradually converges into one point. This point is considered as an optimal point ST.

In the distributed phase type circular polarized wave antenna according to the present invention, the impedance of the power feed point 4 is determined in a conjugate region of the impedance region presenting the good noise figure in FIG. 2. Accordingly, a good impedance matching condition is formed for the circular polarized wave antenna 1 and transistor circuit 9 at the power feed point 4, so that the electromagnetic wave energy captured by the antenna 1 can be transfers to the transistor circuit 9 with extremely high efficiency, and amplified effectively in the transistor circuit 9.

In the first preferred embodiment, since any impedance matching is required between the antenna 1 and the transistor circuit 9, the circular polarized wave receiving module can be miniaturized compared with the conventional antenna requiring the impedance matching circuit. Furthermore, since there is no thermal noise generated by the resistance component included in an element constituting the impedance matching circuit, an excellent noise characteristic can be realized. Therefore, the high-frequency signal superposed on the circular polarized electromagnetic wave with high efficiency can be amplified, while maintaining the low noise figure.

Figure 3:
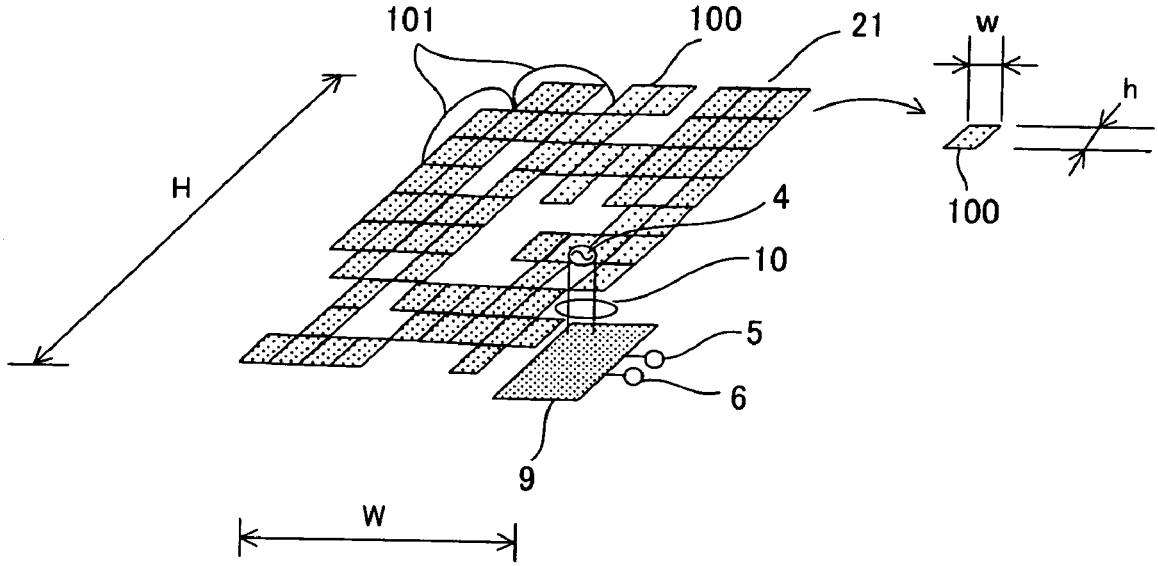
FIG. 3 is a perspective view of a distributed phase type circular polarized wave receiving module for showing elemental structure and configuration in the first preferred embodiment according to the invention.

FIG. 3 is a perspective view of a distributed phase type circular polarized wave receiving module for showing elemental structure and configuration in the first preferred embodiment according to the invention.

In the design of the phase distributed type circular polarized wave antenna 1, as shown in FIG. 3, the antenna 1 comprises a conductor plate 21 composed of a plurality of rectangular conductors 100, and a vacant space (gap) is provided between different rectangular conductors 100 constituting the conductor plate 21, and power is fed to the different rectangular conductors 100 by using the gap as a power feed point 4. A narrow conductor 101 is formed by adjacent ones of the rectangular conductors 100 constituting the conductor plate 21. At this time, different narrow conductors 101 may be commonly composed of same regular conductors 100.

The distributed phase type circular polarized wave receiving module according to the invention comprises the power feed point 4, and the conductor plate 21 comprising a group of the narrow conductors 101 formed on a plane (virtual plane), in which the narrow conductors 101 each having an approximately one-dimensional current distribution are two-dimensionally distributed.

On the narrow conductors 101, the high-frequency current is induced in a longitudinal direction of the narrow conductor 101. In the first preferred embodiment, the rectangular conductors 100 are arranged to from the conductor plate 21 such that vectorial sums of projections of current induced at all narrow conductors 101 constituting the conductor plate 21 to two axes orthogonal to each other that are virtually provided on the conductor plate 21 are approximately equal to each other in amplitude and a phase difference in the vectorial sums of the respective axes is 90°

In the first preferred embodiment shown in FIG. 3, the power feed point 4 is formed on the circular polarized wave antenna 1 in configuration, and the power feed point 4 is coupled to the transistor circuit 9 via signal lines 10. The electromagnetic wave energy captured by the circular polarized wave antenna 1 is input to the transistor circuit 9 through the signal lines 10.

Figure 4:
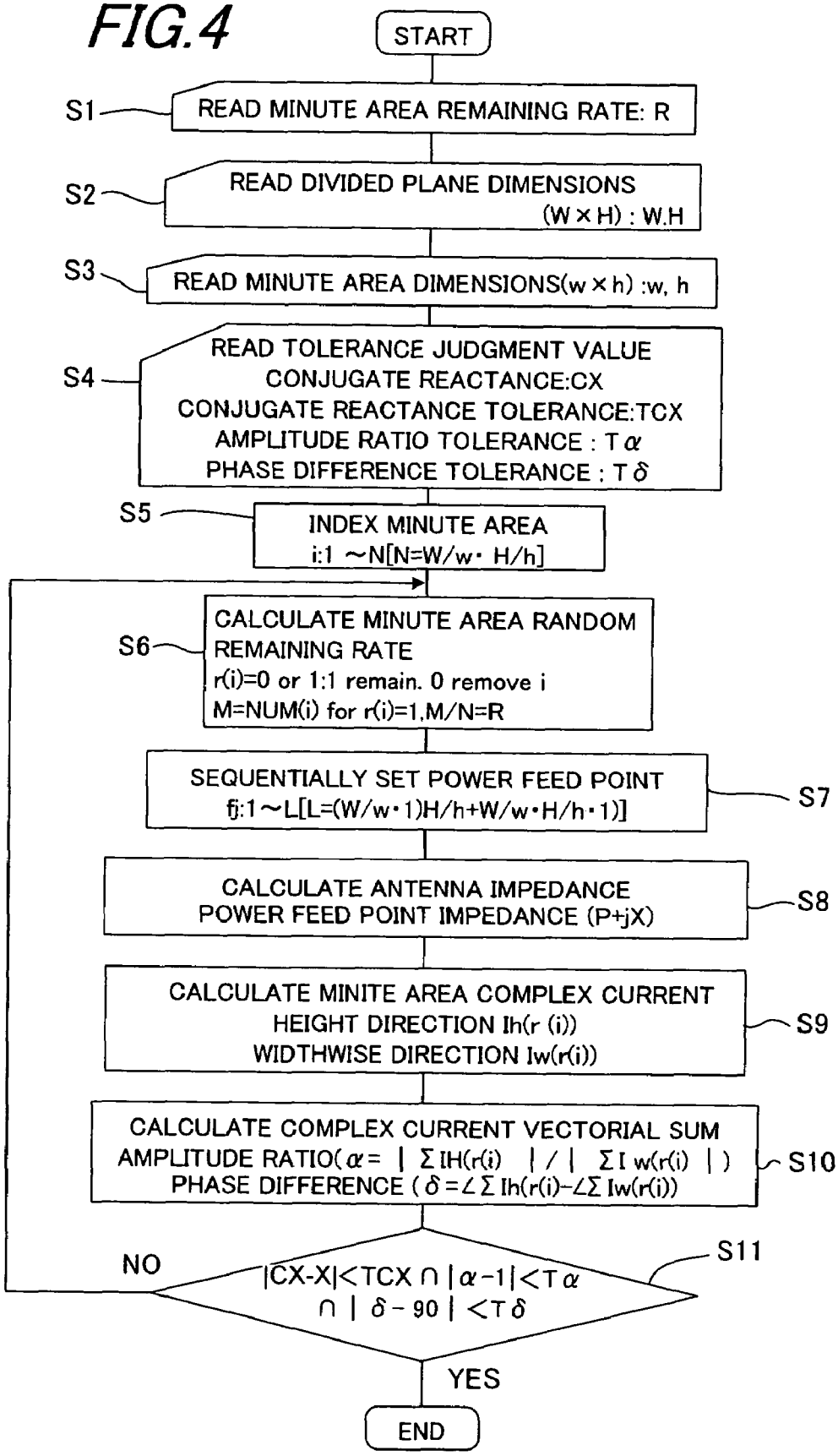
FIG. 4 is a flow chart showing a method for searching a conductor pattern of a distributed phase type circular polarized wave receiving module in the first preferred embodiment according to the invention.

FIG. 4 is a flow chart showing a method for searching a conductor pattern of a distributed phase type circular polarized wave receiving module in the first preferred embodiment according to the invention.

Referring to FIG. 4, an algorithm for determining a concrete structure of the conductor plate 21 comprising a group of the rectangular conductors 100 in the distributed phase type circular polarized wave receiving module will be explained.

The outline of steps shown in FIG. 4 is as follows.

Firstly, assuming that the conductor plate 21 is a rectangular conductor plate, the rectangular conductor plate is virtually divided into minute square areas (square segments). A calculator randomly determines two states of the square segment, i.e. as to whether the square segment should be remained on a divided plane as a rectangular conductor constituting the first or second conductor plate or should be removed, to generate a probable antenna pattern (antenna candidate pattern). For every antenna candidate pattern, a probable power feed point (candidate point) is set in inner sides of the square segments for all possibilities. For every possibility of the candidate point, antenna characteristics (a conjugate value of the reactance value of the input impedance of the transistor circuit at the power feed point and an axis ratio in a distant radiated field) of the antenna candidate pattern are calculated. The antenna candidate patterns having the conjugate value and the axis ratio within an allowable range are adopted as the distributed phase type circular polarized wave antenna.

The process shown in FIG. 4 will be explained in more detail.

At a step S1, a minute area remaining rate (R) is read. The minute area remaining rate R of the square segment on the divided plane is previously determined at the time of conducting the random removal process of the square segments.

At a step S2, divided plane dimensions (W×H) is read. As a matter of convenience, "W" and "H" are defined as shown in FIG. 3. As shown in FIG. 3, "W" and "H" are dimensions of the conductor plate 21, and "W" and "H" are orthogonal to each other.

At a step S3, minute area dimensions (w×h) are read. As shown in FIG. 3, "w" and "h" are dimensions of the rectangular conductor 100 and orthogonal to each other.

At a step S4, a conjugate reactance (CX), a conjugate reactance tolerance (TCX), an amplitude ratio tolerance (T α), and a phase difference tolerance (T δ) are read and set as tolerance judgment value.

At a step S5, the minute areas on the divided plane are indexed. The indexing is conducted by successively numbering the square segments existing on the divided plane, and the calculation may be expressed as:

$$\text{Number 1; } 1\sim N[N=W/w\times H/h] \quad (1).$$

At a step S6, a minute area random remaining rate is calculated, and the calculation may be expressed as:

$$r(i)=0 \text{ or } 1 \text{ (1 is remained area, and 0 is removed area)} \quad (2), \text{ and}$$

$$M=NUM(i) \text{ for } r(i)=1,\ M/N=R \quad (3).$$

The formula (2) indicates that a value of r(i) is 0 or 1, and that the $i^{th}$ minute area is remained when the value of r(i) is 1 while the $i^{th}$ minute area is removed when the value of r(i) is 0.

The formula (3) indicates that a value of M/N is always kept at R wherein a M is a total number of factors in a set of i where the value of r(i) is 1.

At a step S7, a power feed point (fj) is sequentially set in the minute areas in the antenna candidate pattern, and the calculation may be expressed as:

$$Fj:\ 1\sim L[L=(W/w-1)\times H/h+W/w\times(H/h-1)] \quad (4)$$

Herein, fj means a number (serial number) given on each position of the power feed points. The formula (4) indicates an upper limit of possible value of fj obtained from given W, w, H, and h.

At a step S8, the antenna impedance is calculated to provide a power feed point impedance (P+jX).

At a step S9, a complex current in the minute area is calculated. For every minute area, a complex current Ih(r(i)) in a vertical (height) direction and a complex current Iw(r(i)) in a horizontal (widthwise) direction are calculated.

At a step S10, a complex current vectorial sum is calculated after obtaining the complex current in the minute area at the step S9. Herein, an amplitude ratio a and a phase difference δ in two directions (the widthwise direction w and the height direction h) orthogonal to each other are calculated.

The amplitude ratio α is given by:

$$\alpha=|\Sigma Ih(r(i))|/|\Sigma Iw(r(i))| \quad (5).$$

The phase difference δ is given by:

$$\delta=\angle\Sigma Ih(r(i))-\angle\Sigma Iw(r(i)) \quad (6).$$

At a step S11, it is judged as to whether following formula (7) is true or false by using the amplitude ratio α calculated at the step S10, the reactance component of the power feed point impedance (X) calculated at the step S8, and the conjugate reactance (CX), the conjugate reactance tolerance (TCX), the amplitude ratio tolerance (Tα), and the phase difference tolerance (Tδ) read at the step S4.

This judgment is given by:

$$|CX-X|<TCX\cap|\alpha-1|\cap<T\alpha\cap|\delta-90|<T\delta \quad (7)$$

In the judgment at the step S11, if the formula (7) is judged as false (No), the calculation flow is returned to the step S6. Upon returning to the step S6, r(i) is varied randomly. As described above, the calculations at the steps S6 to S10 are newly conducted. As a result, the amplitude ratio α and the resistance component P are varied and the calculated result at the step S11 is also changed.

If the formula (7) is judged as true (Yes), the calculation flow is end. When the formula (7) is judge as true, amplitudes of radiated electromagnetic wave with respect to two axes orthogonal to each other are approximately equal to each other, and an input impedance of the antenna matches with an input impedance of the high-frequency circuit, as well as a phase difference in the radiated electromagnetic wave with respect to the two axes orthogonal to each other is approximately 90°.

As described above, by calculating according to the flow chart shown in FIG. 4, a concrete configuration of the plate conductor 21 comprising a group of the rectangular conductor 100 for the circular polarized wave antenna 1 shown in FIG. 3 can be determined.

According to this method of design, the conductive material in the conductor plate is partially removed and minutely patterned, and a path of the induced current flowing on the conductor plate contributing to radiation and capture of the electromagnetic wave, can be artificially drifted. Compared with the conventional antenna using the conductor plate which is not patterned or the conductor plate which is simply and partially patterned, the induced current having a phase difference around 90° which is a requirement for generating the circular polarized wave can be realized in small dimension.

A distributed phase type circular polarized wave receiving module in a second preferred embodiment according to the invention will be explained referring to FIGS. 5A to 5C.

Figure 5A:
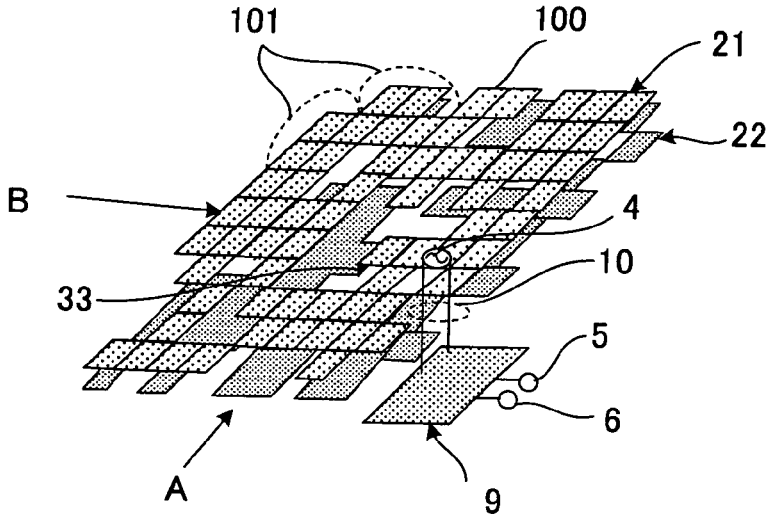
Figure 5B:
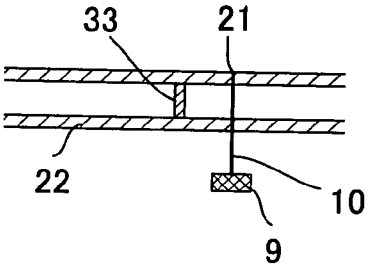
Figure 5C:
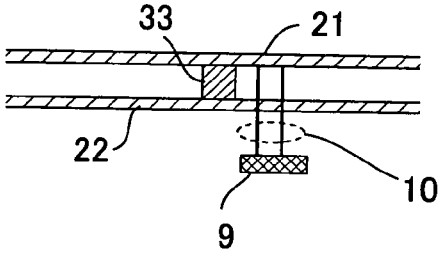

FIGS. 5A to 5C are schematic diagrams showing a distributed phase type circular polarized wave receiving module in the second preferred embodiment according to the invention, wherein FIG. 5A is a perspective view showing a structure of the distributed phase type circular polarized wave receiving module, FIG. 5B is a side view of the distributed phase type circular polarized wave receiving module viewed from a point A, FIG. 5C is a side view of the distributed phase type circular polarized wave receiving module viewed from a point B.

A distributed phase type circular polarized wave receiving module comprises a first conductor plate 21, a second conductor plate 22, a first coupling conductor 33 for coupling the first conductor plate 21 and the second conductor plate 22, a power feed point 4 formed on the first conductor plate 21, a power feed terminal 5, a signal output terminal 6, a transistor circuit 9, and signal lines 10.

The second preferred embodiment is different from the first preferred embodiment shown in FIG. 3 in that the second conductor plate 22 composed of the rectangular conductors 100 is disposed to be opposed to the first conductor plate 21, and the coupling conductor 33 with dimensions less than the rectangular conductor 100 for electrically coupling the first conductor plate 21 and the second conductor plate 22 is provided.

According to the second preferred embodiment, an electric length between one rectangular conductor 100 and another rectangular conductor 100 that can be realized in this antenna structure comprising the first conductor plate 21, the second conductor plate 22, and the coupling conductor 33 can be made longer than that of the antenna structure comprising a single conductor plate 21. Accordingly, the induced current having a phase difference around 90° which is a requirement for designing the circular polarized wave antenna can be realized on the different rectangular conductors 100 in small dimension. Therefore, the dimension of the circular polarized wave antenna can be reduced, so that the distributed phase type circular polarized wave receiving module can be miniaturized.

In the antenna comprising the single conductor plate 21, since the electric length is obtained only through a path along the single conductor plate, the electric length cannot be set longer than the dimensions of the conductor plate. On the other hand, in the antenna comprising a plurality of the conductor plates 21, 22, the electric length is obtained through a long path across a plurality of the conductor plates 21, 22 via the conductor plate 33 coupling a plurality of the conductor plates21, 22.

A distributed phase type circular polarized wave receiving module in a third preferred embodiment according to the invention will be explained referring to FIG. 6.

Figure 6:
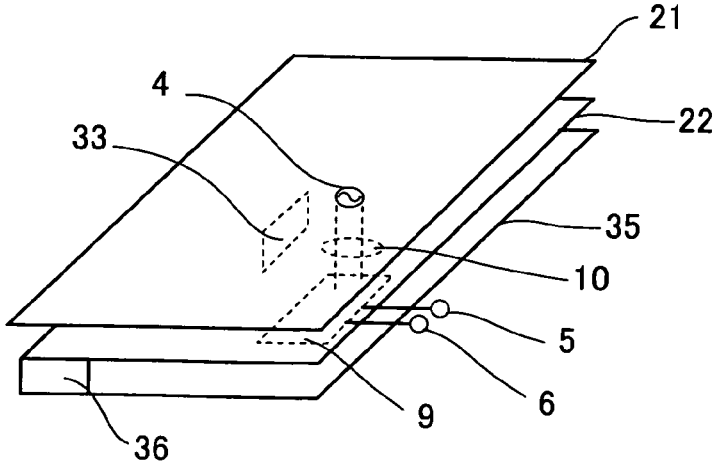
FIG. 6 is a perspective view of a distributed phase type circular polarized wave receiving module in a third preferred embodiment according to the invention.

FIG. 6 is a perspective view of a distributed phase type circular polarized wave receiving module in the third preferred embodiment according to the invention.

A distributed phase type circular polarized wave receiving module comprises a first conductor plate 21, a second conductor plate 22, a first coupling conductor 33 for coupling the first conductor plate 21 and the second conductor plate 22, a third conductor plate 35, a second coupling conductor 36 for coupling the second conductor plate 22 and the third conductor plate 35, a power feed point 4 formed on the first conductor plate 21, a power feed terminal 5, a signal output terminal 6, a transistor circuit 9, and signal lines 10.

The third preferred embodiment is different from the second preferred embodiment shown in FIG. 5 in that the third conductor plate 35 is disposed to be opposed to the second conductor plate 22 at the side different from the first conductor plate 21 with respect to the second conductor plate 22, and the second coupling conductor 36 for electrically coupling the second conductor plate 22 and the third conductor plate 35 is provided. Further, the transistor circuit 9 is disposed at the side different from the first conductor plate 21 with respect to the third conductor plate 35.

According to the third preferred embodiment, when the distributed phase type circular polarized wave receiving module shown in FIG. 5 is mounted on a circuit board, the electromagnetic effect that affects on an antenna constituting the receiving module of the circuit board can be reduced, and a post-adjustment process for correcting alteration of the antenna characteristics after mounting the circuit board can be omitted. Further, an effect for reducing the manufacturing cost of the radio communication device mounting the distributed phase type circular polarized wave receiving module can be obtained.

Namely, unnecessary electromagnetic wave generated by the distributed phase type circular polarized wave receiving module can be shielded by a finite grounding conductor included in the circuit board, namely the arrival of the unnecessary electromagnetic wave can be prevented from the antenna.

A distributed phase type circular polarized wave receiving module in a fourth preferred embodiment according to the invention will be explained referring to FIG. 7.

Figure 7:
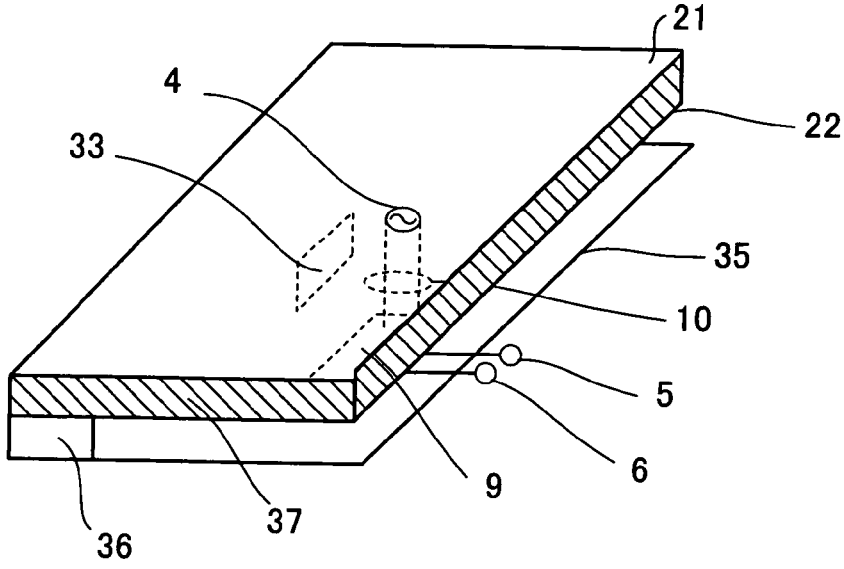
FIG. 7 is a perspective view of a distributed phase type circular polarized wave receiving module in a fourth preferred embodiment according to the invention.

FIG. 7 is a perspective view of a distributed phase type circular polarized wave receiving module in the fourth preferred embodiment according to the invention.

A distributed phase type circular polarized wave receiving module comprises a first conductor plate 21, a second conductor plate 22, a first coupling conductor 33 for coupling the first conductor plate 21 and the second conductor plate 22, a third conductor plate 35, a second coupling conductor 36 for coupling the second conductor plate 22 and the third conductor plate 35, a dielectric material 37 interposed between the first conductor plate 21 and the second conductor plate 22, a power feed point 4 formed on the first conductor plate 21, a power feed terminal 5, a signal output terminal 6, a transistor circuit 9, and signal lines 10.

The fourth preferred embodiment is different from the third preferred embodiment shown in FIG. 6 in that in that a space between the first conductor plate 21 and the second conductor plate 22 is filled with the dielectric material 37.

According to the fourth preferred embodiment, since the dielectric material 37 is interposed at regions where electromagnetic field energy is concentrated between the first conductor plate 21 and the second conductor plate 22, the wavelength of the electromagnetic wave relating to the antenna operation can be compacted by interposing the dielectric material 37. As a result, the antenna structure can be miniaturized. Therefore, an effect for reducing the dimensions of the distributed phase type circular polarized wave receiving module in the third preferred embodiment shown in FIG. 6 can be obtained.

A distributed phase type circular polarized wave receiving module in a fifth preferred embodiment according to the invention will be explained referring to FIG. 8.

Figure 8:
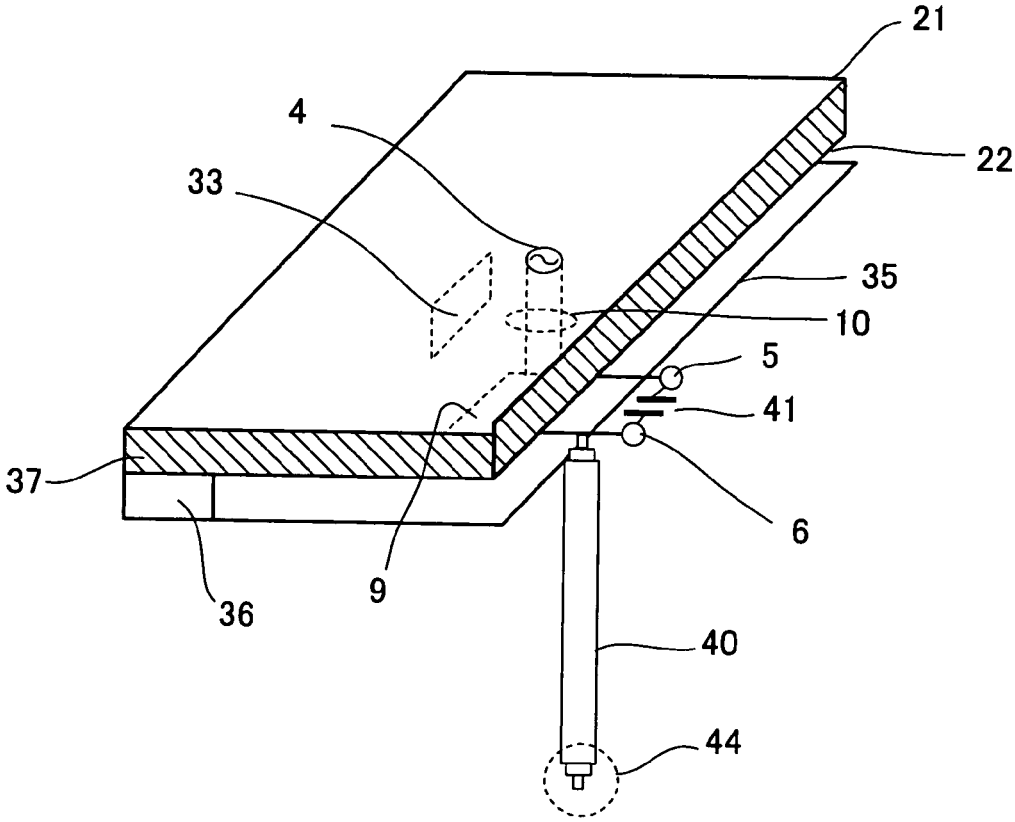
FIG. 8 is a perspective view of a distributed phase type circular polarized wave receiving module in a fifth preferred embodiment according to the invention.

FIG. 8 is a perspective view of a distributed phase type circular polarized wave receiving module in the fifth preferred embodiment according to the invention.

A distributed phase type circular polarized wave receiving module comprises a first conductor plate 21, a second conductor plate 22, a first coupling conductor 33 for coupling the first conductor plate 21 and the second conductor plate 22, a third conductor plate 35, a second coupling conductor 36 for coupling the second conductor plate 22 and the third conductor plate 35, a dielectric material 37 interposed between the first conductor plate 21 and the second conductor plate 22, a power feed point 4 formed on the first conductor plate 21, a power feed terminal 5, a signal output terminal 6, a transistor circuit 9, signal lines 10, a coaxial cable 40, and a AC/DC separating capacitor 41.

The fifth preferred embodiment is different from the third preferred embodiment shown in FIG. 7 in that the AC/DC separating capacitor 41 is interposed between the signal output terminal 6 and the power feed terminal 5, a core of the coaxial cable 40 is coupled to the signal output terminal 6, an outer conductor of the coaxial cable 40 is coupled to a grounding potential of the distributed phase type circular polarized wave receiving module at one end, and another end of the coaxial cable 40 is provided as a power feed point 44 for external connection.

According to the fifth preferred embodiment, since the power feed terminal 5 and the signal output terminal 6 can be taken to the outside by using the coaxial cable 40 (as the power feed point 44 for external connection), there is an effect to increase the choice of design for locating the antenna and the high-frequency circuit for supplying the high-frequency power to the antenna in the radio communication device. Further, it is not necessary to provide an addition electric wire for supplying the power to the distributed phase type circular polarized wave receiving module, so that it is effective for simplifying a hardware for coupling the distributed phase type circular polarized wave receiving module and the radio communication device receiving the signal from the distributed phase type circular polarized wave receiving module.

The distributed phase type circular polarized wave receiving module shown in FIG. 8 is explained in more detail.

One end of the AC/DC separating capacitor 41 is coupled to the signal output terminal 6 and the another end of the AC/DC separating capacitor and the power feed terminal 5 are simultaneously coupled to the one end of the coaxial cable 40. Another end of the coaxial cable 40 functions as an external signal transmitting terminal and an external terminal for power feeding.

A distributed phase type circular polarized wave receiving module in a sixth preferred embodiment according to the invention will be explained referring to FIG. 9.

Figure 9:
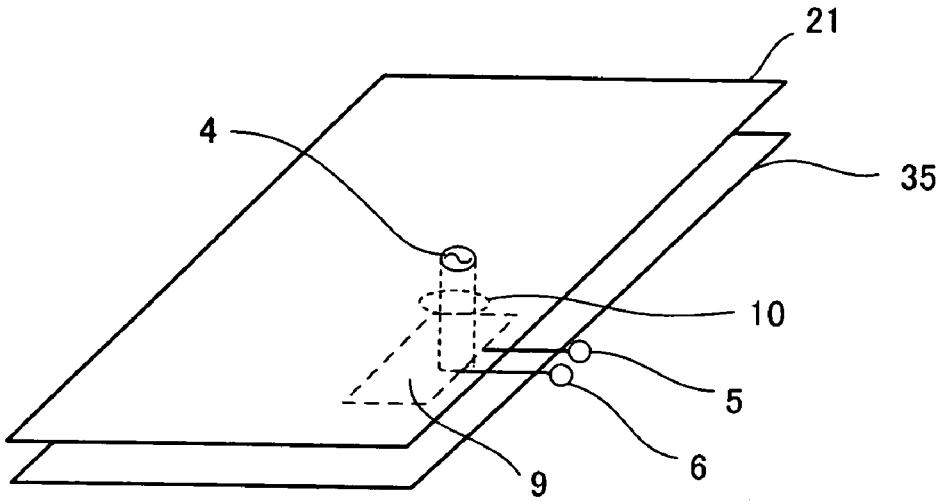
FIG. 9 is a perspective view of a distributed phase type circular polarized wave receiving module in a sixth preferred embodiment according to the invention.

FIG. 9 is a perspective view of a distributed phase type circular polarized wave receiving module in the sixth preferred embodiment according to the invention.

A distributed phase type circular polarized wave receiving module comprises a first conductor plate 21, a third conductor plate 35, a power feed point 4 formed on the first conductor plate 21, a power feed terminal 5, a signal output terminal 6, a transistor circuit 9, and signal lines 10.

The sixth preferred embodiment is different from the first preferred embodiment shown in FIG. 3 in that the third conductor plate 35 is disposed to be opposed to the first conductor plate 21, and the transistor circuit 9 is disposed at the side different from the first conductor plate 21 with respect to the third conductor plate 35.

According to the sixth preferred embodiment, when the distributed phase type circular polarized wave receiving module shown in FIG. 3 is mounted on a circuit board, the electromagnetic effect that affects on an antenna constituting the receiving module of the circuit board can be reduced. Namely, unnecessary electromagnetic wave generated by the distributed phase type circular polarized wave receiving module can be shielded by a finite grounding conductor included in the circuit board, namely the arrival of unnecessary electromagnetic wave can be prevented from the antenna. Therefore, a post-adjustment process for correcting alteration of the antenna characteristics after mounting the circuit board can be omitted. Further, an effect for reducing the manufacturing cost of the radio communication device mounting the distributed phase type circular polarized wave receiving module can be obtained.

Otherwise, the transistor circuit 9 may be disposed at the side different from the first conductor plate 21 with respect to the third conductor plate 35 without electrically contacting with the third conductor plate 35, by passing the signal lines 10 through a hole provided at the third conductor plate 35. For this case, it is possible to realize a high-frequency shield for the circular polarized wave antenna 1 with respect to the transistor circuit 9, so that the operation of the transistor circuit 9 can be stabilized.

A distributed phase type circular polarized wave receiving module in a sixth preferred embodiment according to the invention will be explained referring to FIG. 9.

Figure 10:
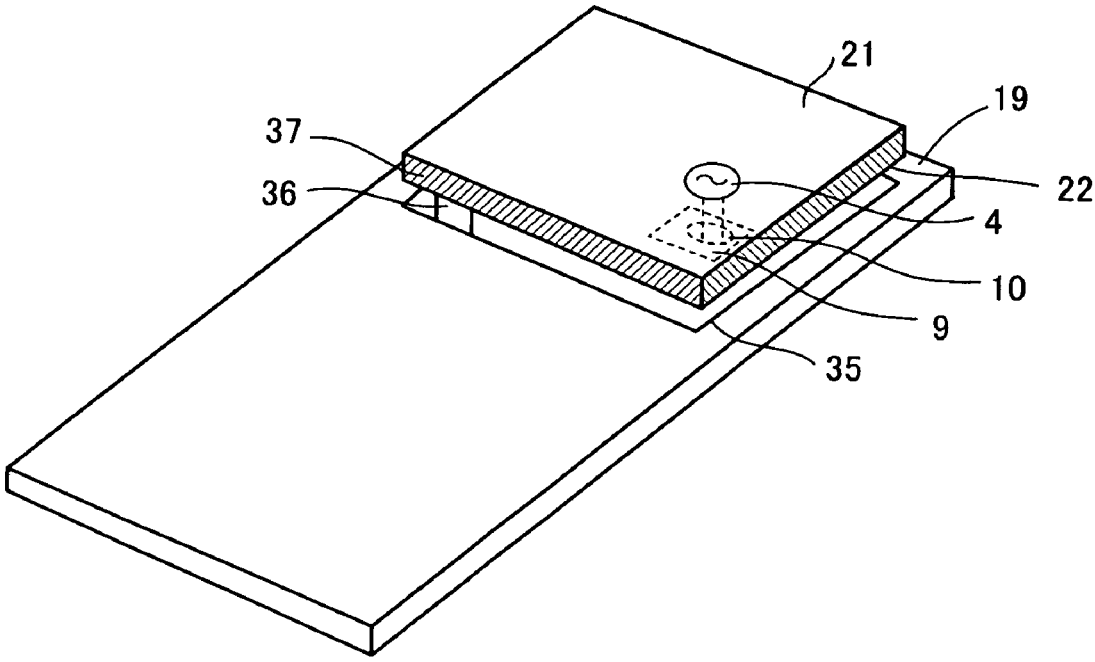
FIG. 10 is a perspective view of the distributed phase type circular polarized wave receiving module mounted on a circuit board in a seventh preferred embodiment according to the invention.

FIG. 10 is a perspective view of the distributed phase type circular polarized wave receiving module mounted on a circuit board in the seventh preferred embodiment according to the invention.

A distributed phase type circular polarized wave receiving module comprises a first conductor plate 21, a second conductor plate 22, a third conductor plate 35, a power feed point 4 formed on the first conductor plate 21, a circuit board 19, a transistor circuit 9, signal lines 10, a second coupling conductor 36 for coupling the second conductor plate 22 and the third conductor plate 35, and a dielectric material 37 interposed between the first conductor plate 21 and the second conductor plate 22.

The seventh preferred embodiment is characterized by that the distributed phase type circular polarized wave receiving module in the fourth preferred embodiment shown in FIG. 7 is installed on the circuit board 19. In addition, the third conductor plate 35 is electrically connected to a grounding potential of the circuit board 19. The signal output terminal 6 (not shown) and the power feed terminal 5 (not shown) of the distributed phase type circular polarized wave receiving module are connected to a high-frequency circuit (not shown) and a power source circuit (not shown), which are separately mounted on the circuit board 19.

According to the seven preferred embodiment, for designing the distributed phase type circular polarized wave receiving module according to present invention, the electromagnetic effect of the finite grounded conductor 19 can be incorporated. By using such the antenna search technique for searching a group of the rectangular conductors composing the first conductor plate 21 and the second conductor plate 22, which constitute the circular polarized wave antenna 1, it is possible to realize the antenna search previously incorporating the alteration of the antenna characteristics when the distributed phase type circular polarized wave antenna is installed on the circuit board, etc. It is effective for controlling characteristic degradation in mounting the distributed phase type circular polarized wave antenna in a radio communication device.

A communication device mounting a distributed phase type circular polarized wave receiving module in an eighth preferred embodiment according to the invention will be explained referring to FIG. 11.

Figure 11:
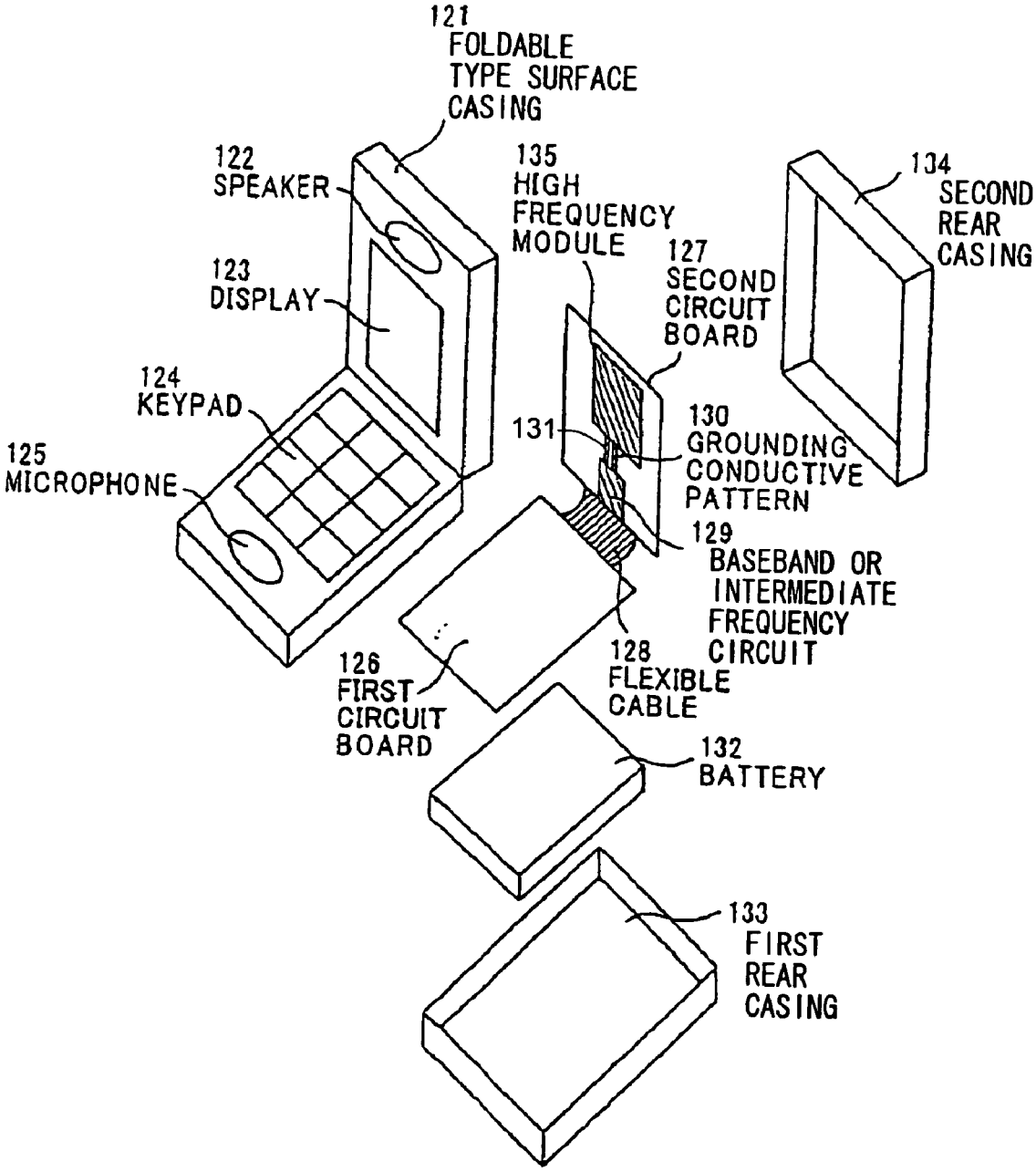
FIG. 11 is a disassembled perspective view of a radio communication device mounting a high-frequency module in an eighth preferred embodiment according to the present invention.

FIG. 11 is a disassembled perspective view of a communication device mounting a distributed phase type circular polarized wave receiving module in the eighth preferred embodiment according to the present invention.

A speaker 122, a display 123, a keypad 124, and a microphone 125 are mounted on a foldable type surface casing 121. A first circuit board 126 and a second circuit board 127 are connected by a flexible cable 128 accommodated within the foldable type casing 121. On the first circuit board 126 and/or second circuit board 127, a baseband or intermediate frequency circuit 129 and a high-frequency module 135 according to the invention are mounted, and grounded conductive patterns 130, 131 for coupling a signal of the high-frequency module 135 and the baseband or intermediate frequency circuit 129, a control signal, and a power source is formed thereon. The first circuit board 126 and second circuit board 127 together with a battery 132 are accommodated in a first rear casing 133 and a second rear casing 134.

A characteristic feature of this structure is that the high-frequency module 135 according to the present invention is located on an opposite side of the display 123 or the microphone 125 with respect to the second circuit board 127.

According to the eighth preferred embodiment, a radio communication terminal enjoying plural radio system services can be realized in a form of a built-in antenna. Therefore, it is effective in miniaturization of the radio communication terminal and improvement of user's convenience for storage and portability.

A communication device mounting a distributed phase type circular polarized wave receiving module in a ninth preferred embodiment according to the invention will be explained referring to FIG. 12.

Figure 12:
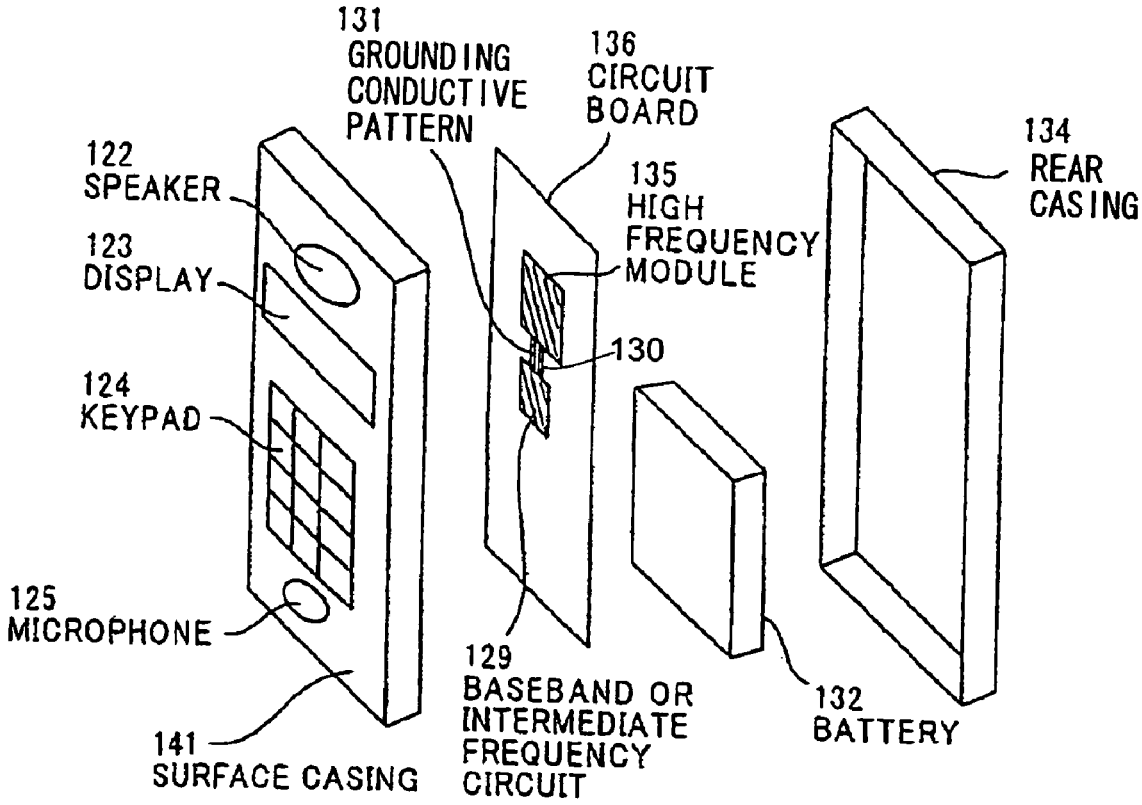
FIG. 12 is a disassembled perspective view of a portable radio communication device mounting a high-frequency module in a ninth preferred embodiment according to the present invention.

FIG. 12 shows a disassembled perspective view of a portable radio communication device mounting a high-frequency module in the ninth preferred embodiment according to the present invention.

A speaker 122, a display 123, a keypad 124, and a microphone 125 are mounted on a surface casing 141, and a circuit board 136 is accommodated within the surface casing 141. On the circuit board 136, a baseband or intermediate frequency circuit 129 and a high-frequency module 135 according to the invention are mounted, and grounded conductive patterns 130, 131 for coupling a signal of the high-frequency module 135 and the baseband or intermediate frequency circuit 129, a control signal, and a power source is formed. The circuit board 136 together with a battery 132 is accommodated in a rear casing 134.

A characteristic feature of this structure is that the high-frequency module 135 according to the present invention is sandwiching the circuit board and located on an opposite side the microphone 125, the speaker 122, or the keypad 124 with respect to the circuit board 136.

According to the ninth preferred embodiment, a portable radio communication terminal enjoying plural radio system services can be realized in a form of a built-in antenna. Therefore, it is effective in miniaturization of the radio communication terminal and improvement of user's convenience for storage and portability.

Compared with the eighth preferred embodiment shown in FIG. 11, since the circuit board and the casing can be fabricated integrally, it is effective for miniaturization of the terminal surface and reduction of manufacturing cost by reducing the number of assembling steps.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A distributed phase type circular polarized receiving module, comprising:

a power feed point and a first group of narrow conductors having a substantially one-dimensional current distribution being formed at a common plane as a first plane, the first group of narrow conductors being distributed in two dimensions on the first plane; and a transistor connected to the power feed point;

a second group of narrow conductors having a substantially one-dimensional current distribution formed at a second plane, the second group of narrow conductors being distributed in two dimensions on the second plane;

wherein:

sums of projections of complex vectors of current distributions induced on the narrow conductors in first and second directions orthogonal to each other defined on the first and second planes are determined in amplitude and phase, such that amplitudes are approximately equal to each other and a phase difference is approximately 90°, wherein the power feed point is provided at a position where an input impedance of the antenna is complex conjugated with an input impedance of the transistor.

2. The distributed phase type circular polarized receiving module, according to claim 1, wherein:

a space between the first plane and the second plane is filled with a dielectric material.

3. The distributed phase type circular polarized receiving module, according to claim 1, wherein:

the first group of narrow conductors and the second group of narrow conductors are coupled to each other and the power feed point is included in the narrow conductors.

* * * * *